United States Patent [19]

Gidge et al.

[11] 4,420,027

[45] Dec. 13, 1983

[54] TRANSPARENT ACCESS CURTAIN FOR COOLERS AND THE LIKE

[75] Inventors: Kenneth N. Gidge, Nashua, N.H.; Henry J. Richard, Lowell, Mass.

[73] Assignee: BSL Corporation, Nashua, N.H.

[21] Appl. No.: 494,499

[22] Filed: May 18, 1983

Related U.S. Application Data

[63] Continuation of Ser. No. 287,303, Jul. 27, 1981.

[51] Int. Cl.[3] ..... A47H 23/01

[52] U.S. Cl. ..... 160/328

[58] Field of Search ..... 160/184, 327, 328, 329, 160/332, 349; 312/116, 138, 297

[56] References Cited

U.S. PATENT DOCUMENTS

| | | | |
|---|---|---|---|
| 2,041,258 | 5/1936 | Mitchell | 160/DIG. 8 |
| 3,632,154 | 1/1972 | Woodrich | 160/349 R |
| 3,809,144 | 5/1974 | Garudo | 160/184 |
| 4,288,992 | 9/1981 | Eliason | 312/116 |
| 4,313,485 | 2/1982 | Gidge | 160/328 |
| 4,367,781 | 1/1983 | Vallienco, Jr. et al. | 160/184 |

*Primary Examiner*—Peter M. Caun

[57] ABSTRACT

A transparent, flexible curtain with spaced access slits is provided for installation across the opening of display type, open front and open top coolers, freezers and the like of the sort used in retail food stores. The curtain is comprised of a rectangular sheet of flexible, transparent material detachably secured at one end to the top or rear edge of the cooler cabinet and extending across the cabinet opening. The upper and lower margins are reinforced by a flexible laminated scrim for improved wear at the stress points. The curtain is formed with plurality of spaced parallel slits, all extending in the same direction and all originating and terminating within the margins of the sheet with the exception of a slit along a fold line extending through the lower edge of the curtain. The curtain retains cold air within the refrigerator and allows the food products to be clearly visible to the customer. Goods are removed by the customer reaching through any slit near the product selected. The forward or lower edge of the curtain is weighted in sections to keep the curtain taut across the opening and to allow it to be folded back for loading food into the cooler.

12 Claims, 12 Drawing Figures

TRANSPARENT ACCESS CURTAIN FOR COOLERS AND THE LIKE

This application is a continuation of application Ser. No. 287,303, filed July 27, 1981.

BACKGROUND OF THE INVENTION

1. Field of the Invention

This invention relates generally to covers for open front and open top refrigerators, coolers and the like and more particularly is directed towards a flexible access curtain for use of commercial open refrigerators, such as used in retail food stores.

2. Description of the Prior Art

A great many retail food stores have refrigerators, freezers and coolers in which various types of foods such as dairy produce and frozen foods are stored until purchased by the customer. Because of the need for constant and easy access into such refrigerating chests, particualrly in a busy market, many of these units are made with open fronts or open tops which allow the customer to reach directly in and remove whatever item he or she has selected. Refrigerators of this type rely upon the higher density of cold air to retain the chilled air within the chest. Also, many of these units are equipped with a blower system that produces a multiple strata air curtain across the cabinet opening as a means for retaining refrigerated air with the chest. While such refrigerators work effectively in keeping the foods chilled, they do require a substantial amount of energy to operate, since the openings in the chest usually run the full width of the unit and are often quite large. Refrigerated air within the unit is continuously lost through natural causes such as drafts, convection, movements of the food products by the customer, etc. and requires more running time of the refrigerating machinery to maintain the desired temperature in the chest. This of course, increases heating costs of the store during cold weather.

While it is possible to install solid doors, either opaque or transparent, on such refrigerators in order to retain cold air, the inconvenience to the customer is objectionable and hinged doors may interfere with traffic flow along narrow store aisles. Also, many customers often leave refrigerator doors ajar so that the function of the door is defeated. It has also been found that transparent doors that are being opened and closed frequently will quickly frost over on the inside so that the refrigerator contents cannot be seen from the outside.

Accordingly, it is an object of the present invention to provide improvements in closures for open-type retail refrigerators. Another object of this invention is to provide a novel access curtain for an open-type refrigerator. A further object of this invention is to provide an energy saving transparent, flexible curtain for an open refrigerator in which the refrigerator contents are readily accessible and the curtain remains essentially closed even when the goods are being withdrawn.

SUMMARY OF THE INVENTION

This invention features a curtain for installation across the open top or front of a commercial retail display-type refrigerator, comprising a rectangular sheet of flexible, transparent material reinforced by a flexible laminated scrim along its upper and lower edges and detachably connected at its upper edge along the top or rear edge of the refrigerator opening and extending across the cabinet opening. The sheet is formed with a plurality of spaced, parallel, inboard slits, all extending in the same direction to provide access to the cabinet through the curtain. In one embodiment a slit along a fold line extends through the lower edge of the curtain to facilitate folding. Horizontal rods or other weight means are attached to the lower edge of the curtain to keep the curtain drawn tightly across the opening and allow the curtain to be folded back for loading purposes. Fastening means at the outer faces of the two upper corners allow one upper corner to be held against the other upper corner when one side of the curtain is folded back against the other side when loading the cabinet.

DETAILED DESCRIPTION OF THE PREFERRED EMBODIMENTS

Figure 3:
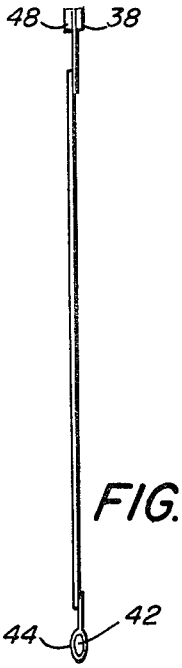
FIG. 3 is an end view thereof.
Figure 1:
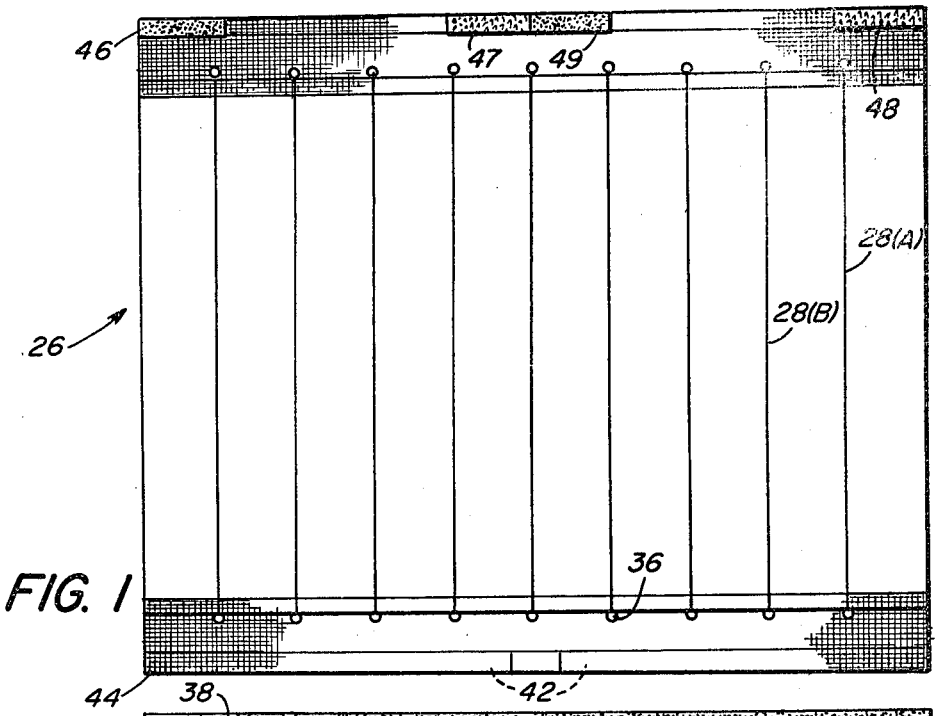
FIG. 1 is a front view of an access curtain made according to the invention.
Figure 2:
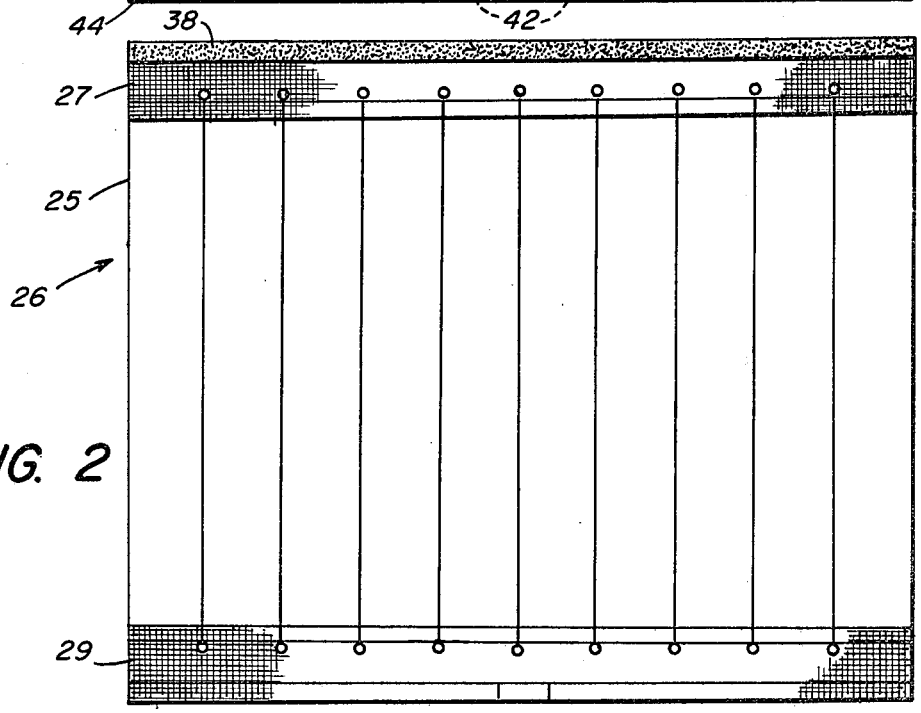
FIG. 2 is a rear view of the FIG. 1 curtain.
Figure 5:
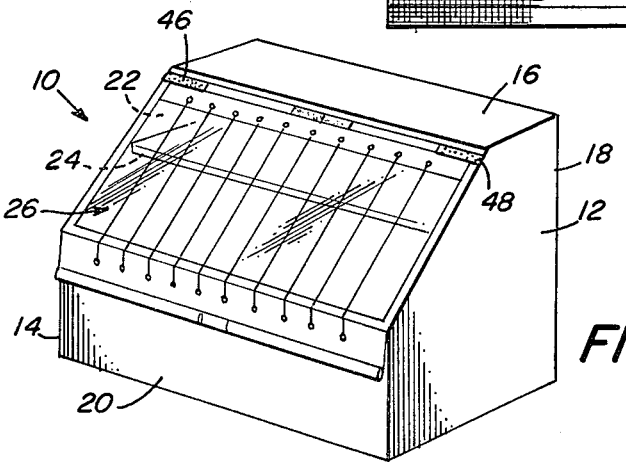
FIG. 5 is a perspective view of the curtain installed on a typical commercial display refrigerator.
Figure 4:
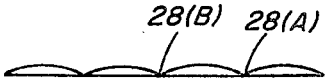
FIG. 4 is a detailed sectional view showing the shape of the curtain strips.
Figure 6:
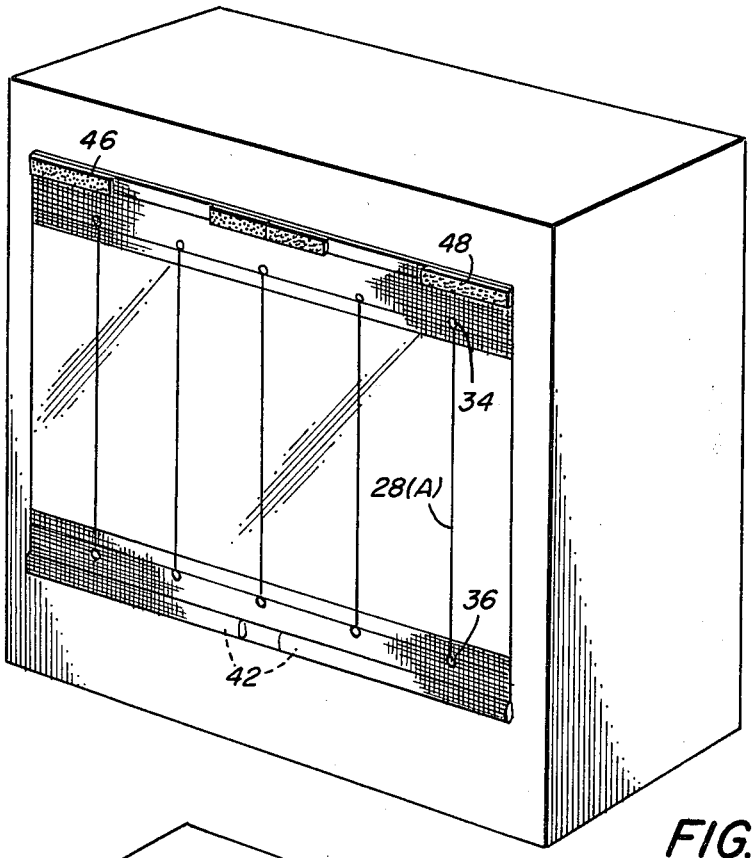
FIG. 6 is a perspective view showing the curtain hung on an open front refrigerator.
Figure 7:
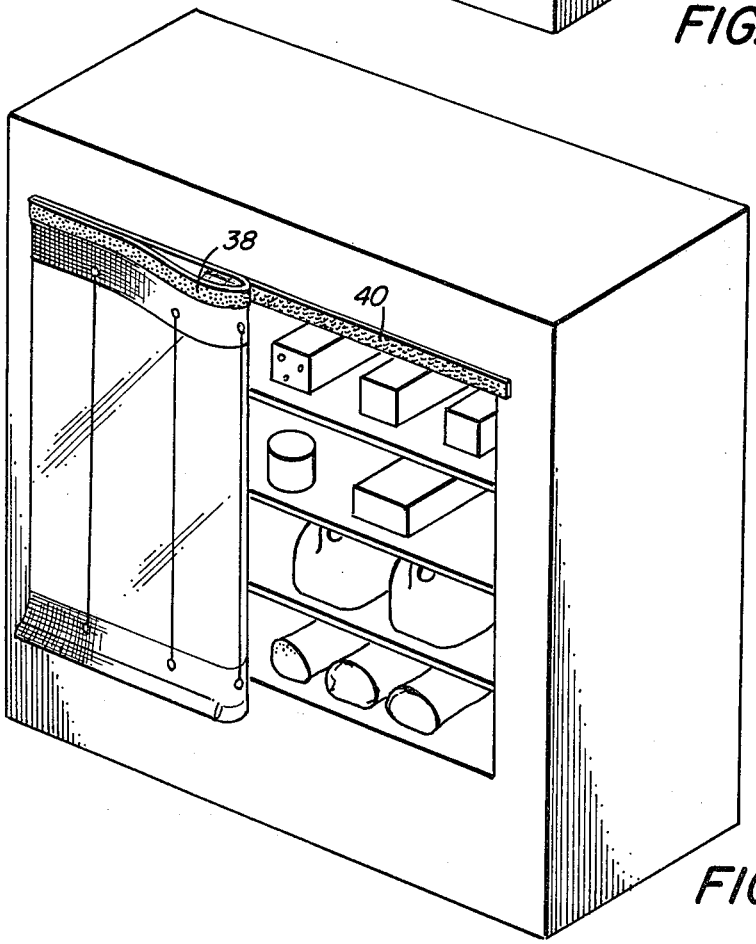
FIG. 7 is a view similar to FIG. 6 showing the curtain in a folded position.
Figure 9:
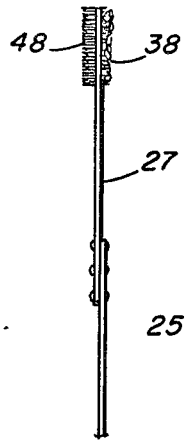
FIG. 9 is an end view thereof.
Figure 8:
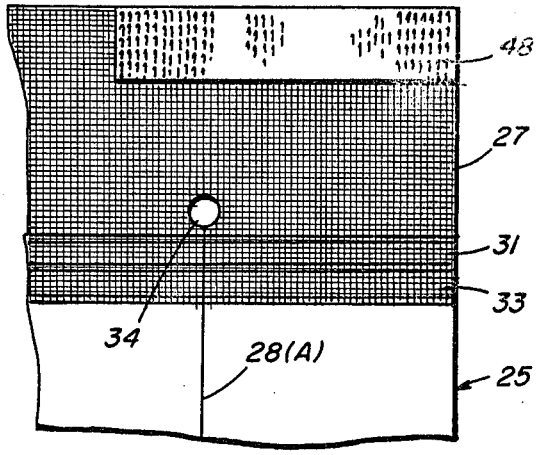
FIG. 8 is a detail front view showing an upper corner of the curtain.
Figure 11:
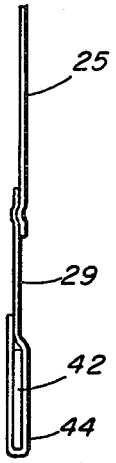
FIG. 11 is an end view thereof, and, FIG. 12 is a front view showing a modification of the invention.
Figure 10:
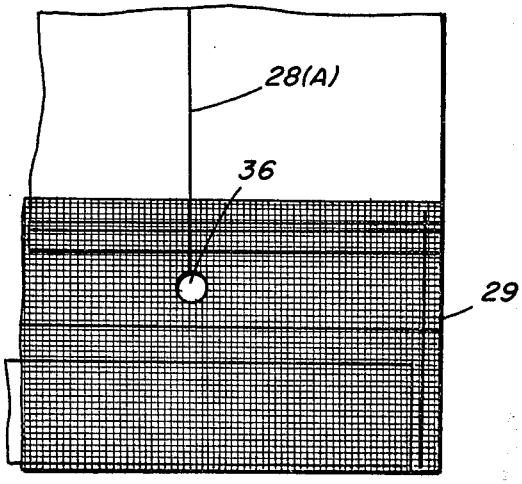
FIG. 10 is a detail front view showing a lower corner of the curtain.

Referring now to the drawings and to FIGS. 1 through 11 in particular, the reference character 10 generally indicates a refrigerator unit of the sort commonly employed in retail food markets and adapted to store and display various types of food products such as dairy produce, frozen foods, meats, etc. that must be kept refrigerated. The unit 10 typically is formed with side walls 12 and 14, a relatively narrow top wall 16, a full height rear wall 18, and a relatively short front wall 20. The walls define a housing with an inclined open front 22 providing access to various food items supported on shelves 24. Typically, the refrigeration mechanism is located within the housing unit 10 and circulates cold air through the storage portion of the chest. Many units of this type also are equipped with a blower system that directs a multiple layer air curtain across the opening as a means to entrap cold air in the case.

The opening 22 generally is quite large and typically extends the full width of the unit and a substantial portion of the height thereof, so that all shelves and bins are freely accessible to the customers. In practice, the refrigerator opening 22 is left fully open during normal business hours although it may be covered by a tarpaulin, or the like, when the store is closed. With the refrigerator unit 10 open, a substantial amount of energy is required to keep the food produce at the proper temperature because of the large losses of chilled air through the opening 22.

In accordance with the present invention, a flexible, transparent curtain, generally indicated by the reference character 26, is provided across the opening 22. The curtain 26 is of rectangular shape and attached along its upper edge of the upper wall 16 along the edge of the opening 22 and extending down over the opening 22 to drape across the upper edge of the front wall 20. The size of the curtain is sufficient to cover the opening 22 with a slight overlap.

The curtain is comprised of a main rectangular sheet 25 and a pair of reinforcing strips 27 and 29 connected to the main sheet 25 respectively along the upper and lower margins thereof. The strips 27 and 29 are of a tough flexible material adapted to withstand long, hard use without cracking or tearing. While various materials may be used one material that has proven particularly satisfactory is a scrim comprised of a weave of fabric sold under the Trademark "Herculon" laminated in a clear thermoplastic flexible stratum. The scrim is strong, tough and flexible, will not tear easily and can be heat sealed to the main sheet 25 as by heat seal lines 31 and 33 shown best in FIGS. 8 and 9.

The curtain is formed with a plurality of spaced parallel slits 28(A), 28(B) etc. defining self-closing access openings through the curtain. The openings are self-closing by virtue of the fact that the slits originate and terminate within the margins of the curtain and do not extend to either edge thereof. In the preferred embodiment the slits are straight and extend vertically of the curtain. Typically, all of the slits are spaced about 3" apart although this obviously may be varied through a wide range, up to perhaps 2', for example, or the slit spacings may alternate from wide to narrow. In any event all of the slits 28 preferably are of the same length and terminate at their upper ends and at their lower ends inside the scrim strips 27 and 29 respectively. The upper strip 27 preferably is formed with a small circular opening 34 at the upper end of each slit which serves as a vent through the curtain for heat produced by the refrigeration machinery and released at the top of the unit and also to prevent tearing of the curtain at the end of the slit. A similar opening 36 is formed inside the lower scrim strip 29 at the lower end of each slit.

The curtain may be made up in a wide variety of widths and lengths with typical dimensions being on the order of perhaps $4\frac{1}{2}'$ in width and a length of perhaps $5\frac{1}{2}'$ depending upon the size of the opening as well as the number of access points desired through the curtain. These dimensions are only by way of example and can be increased or decreased according to particular requirements. Various plastic sheet materials may be used and should be transparent, relatively flexible, stable and durable and not readily subject to cracking from cold or abrasion which may tend to impair the transparency of the panels.

The curtain may be attached to the chest by various means such as detachable fasteners of the sort sold under the trademark Velcro, or the like, which allow the curtain to be fully or partially detached for cleaning or replacement or for restocking the refrigerator, as required. One part of the Velcro strip, indicated at 38, is applied along the full width of the inner upper edge of the curtain while the other part 40 is applied to the chest above the opening 22 coextensive with the part 38. Plastic such as vinyl, polyethylene, or the like may be used to fabricate the main sheet 25 of the curtain and clear polyvinyl chloride (PVC) is particularly suitable for this purpose. The material may be provided in various thicknesses from a relatively thin gauge of about 6 mils up to perhaps 50 gauge material, for example.

It has been found that when the sheet of flexible plastic material used for the curtain is slit in the manner described, the vertical strips between each pair of slits curl slightly. The curling results in a plurality of strips that in transverse cross-section are shallow, semi-tubes best shown in FIG. 4.

The semi-tubular strips not only provide some longitudinal rigidity to each flexible strip so as to prevent the curtain from draping excessively into the refrigerator opening 22, but also facilitates access through the slits. A customer wishing to purchase an item of food within the case, simply inserts his or her hand through a slit near the selected food item. The curvature of the strips on either side of the slit allows the customer to insert his or her hand smoothly through the curtain and withdraw it with the food item.

The lower end of the curtain should overhang the upper edge of the front wall 20 by several inches in order to allow the curtain to move in and out to some extent as a result of customers reaching through the curtain and partially displacing it. In order to improve the hang of the curtain, the lower end of the curtain is provided with weights such as sections of metal pipe, flat steel bars or rods 42 mounted in a sleeve 44 formed along the lower edge of the curtain. The weight of the rods provides increased tension to the curtain within the scrim 29 to ensure that the curtain remains in proper position across the opening despite frequent displacement by customers. Typical dimensions of the bars 42 are 14 gauge$\times 1\frac{1}{2}'' \times 19\frac{1}{2}''$. Weighting of the curtain can also be achieved by employing thick, heavy sections of plastic or by folding the single layer of scrim into many layers generally corresponding in weight to a metal bar.

The bottom hem of the curtain forming the sleeve 44 should be turned to the inside of the curtain so that any condensation on the outside of the curtain will run off the bottom of the curtain rather than collect in the sleeve and cause rusting of the weight.

By using two or more lengths of rods 42 rather than a single piece extending the full width of the curtain, a stockboy can readily fold either end of the curtain back in order to restock the shelves in the unit through a large opening rather than through the curtain slits. The rods 42 should be spaced slightly apart in end-to-end relation to allow the curtain to be folded conveniently at spaces between the ends of the rod. The upper edge of the curtain may be partially detached by peeling apart the Velcro connectors above the section of curtain to be folded back. Once the unit has been restocked, the curtain is closed by re-attaching the Velcro fasteners and folding that section of curtain back in place.

As indicated above, the curtain is attached to the top of the cabinet by means of Velcro strips 38 and 40, one part 40 attached to the cabinet above the front opening and the other part 38 attached along the upper inner margin of the curtain. The front of the curtain is also provided with short sections 46, 48 of Velcro at the uppers corners thereof and short sections 47 and 49 at the upper center thereof. One section is hooked (male) while the other is felt (female) whereby the curtain may be peeled back as suggested in FIG. 6 for loading and unloading the cabinet. In such event the upper adjacent corners of the curtain are pressed together and held by the Velcro sections 46 and 48 until the curtain is to be returned to its closed position. Typically, the sections 46 and 48 are about $4\frac{1}{2}''$ long. Short sections of weights 42, which may be two or more in number, along the bottom of the curtain allow the curtain to be folded in the manner described. The Velcro section 47 (male) and 49 (female) aid in holding the curtain sections in place when folded open and also permit either corner to be held at the mid-portion of the curtain by either section 47 or 49 if only a small end portion of the curtain is to be folded back rather than the entire half of the curtain.

Figure 12:
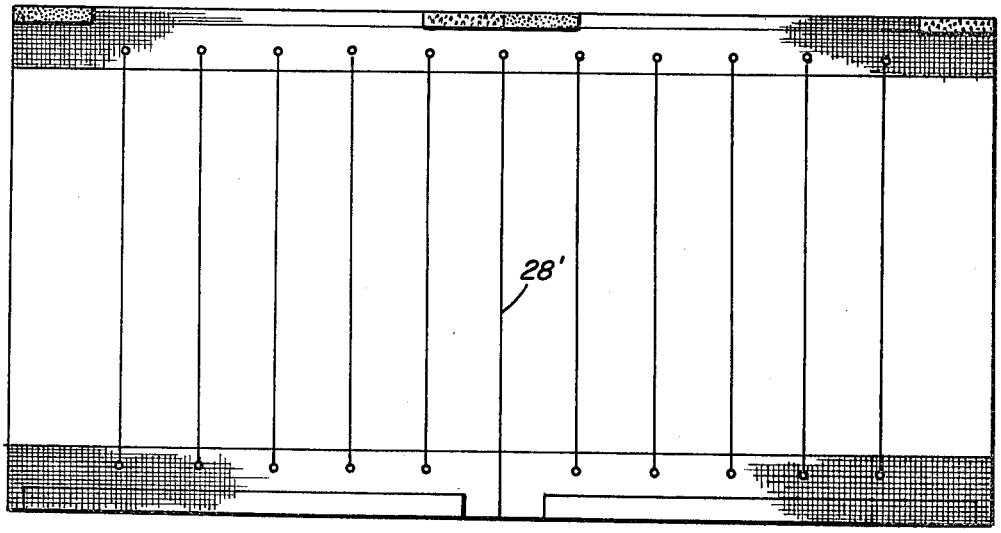

Referring now to FIG. 12, there is shown a modification of the invention and, in this embodiment, a curtain 26' is provided for installation on an open type refrigerator and is similar to the curtain 26 of the principal embodiment with the exception that a slit 28' along a fold line extends through the lower edge of the curtain. All other slits in the curtain are as in the principal embodiment. By extending the slit 28' at the fold line in this manner, the curtain can be folded back and fourth without forming a crease along the lower edge of the curtain. As a result the curtain will hang smoothly and flat against the refrigerator cabinet even after prolonged use and frequent foldings.

While the invention has been described with particular reference to the illustrated embodiments, numerous modifications thereto will appear to those skilled in the art.

Having thus described the invention, what we claim and desire to obtain by Letters Patent of the United States is:

1. An access curtain for use over the opening in an open display type refrigerator, or the like, comprising (a) a sheet of flexible, transparent material of generally rectangular outline, (b) a pair of strips of flexible, tear-resistant reinforcing material, one strip being joined to an upper portion of said sheet and the other strip being joined to a lower portion of said sheet, (c) means carried by at least a portion of the upper of said strips and/or by at least a portion of the refrigerator for connecting the upper of said strips to said refrigerator proximate to the upper edge of said opening, said sheet together with said strips defining a curtain of a length sufficient to span said opening and overhang the lower edge of said opening, (d) said curtain being formed with a plurality of spaced parallel vertical slits disposed entirely within the outer edges of said curtain, said slits extending through said sheet and terminating at respective ends within said upper and lower strips, (e) said slits forming a plurality of substantially coplanar, parallel and integral strip sections arranged in substantially abutting edge to edge relation, and, (f) means carried by the curtain at the lower edge thereof for applying tension to said curtain.

2. An access curtain according to claim 1 wherein said slits are all of equal length.

3. An access curtain according to claim 1 wherein said strips are formed with a circular opening at the ends of said slits.

4. An access curtain according to claim 1 wherein said means for applying tension include weights.

5. An access curtain according to claim 1 and further including cooperating detachable fastening means disposed at both upper adjacent corners on the outer face of said curtain whereby said curtain may be partially separated from said refrigerator at either upper corner and folded back against itself from either upper corner and the upper adjacent corners held together by said fastening means.

6. An access curtain according to claim 5 wherein said tension-applying means includes a plurality of separated weight elements permitting folding of said curtain.

7. An access curtain according to claim 5 wherein said curtain is formed with a slit extending from within said upper strip through said lower strip along a fold line of said curtain.

8. An access curtain according to claim 1 wherein the connecting means comprise detachable fastening means connecting said upper strip to said refrigerator.

9. An access curtain according to claim 8 wherein said connecting means include a strip of felt material carried on any one of the curtain or the refrigerator and a strip of flexible hooked material carried on the other of the curtain or the refrigerator, the strip of felt material and the strip of hooked material being mutually attachable and detachable to detachably connect the curtain to the refrigerator.

10. An access curtain according to claim 4 wherein said weights include at least one elongated metal member, said lower strip being formed with a sleeve along the lower margin thereof, said metal member being mounted in said sleeve.

11. An access curtain according to claim 1 wherein said sheet and said strip are thermoplastic and are heat-sealed together into a unitary integral structure.

12. An access curtain according to claim 1 wherein said strips are comprised of a lamination of a woven scrim and at least one ply of transparent thermoplastic sheet material forming a unitary integral structure.

* * * * *

UNITED STATES PATENT AND TRADEMARK OFFICE

CERTIFICATE OF CORRECTION

PATENT NO. : 4,420,027

DATED : December 13, 1983

INVENTOR(S) : Kenneth N. Gidge and Henry J. Richard

It is certified that error appears in the above-identified patent and that said Letters Patent are hereby corrected as shown below:

Title page,

The "Related U.S. Application Data" should be as follows:

-- This is a continuation of Serial No. 287,303, filed July 27, 1981, which is a continuation-in-part of Serial No. 093,193, filed November 13, 1979, now U.S. Patent 4,313,485. --

Signed and Sealed this

*Eighteenth* Day of *September 1984*

[SEAL]

*Attest:*

GERALD J. MOSSINGHOFF

*Attesting Officer*

*Commissioner of Patents and Trademarks*